United States Patent [19]

Ferguson

[11] Patent Number: 4,698,035

[45] Date of Patent: Oct. 6, 1987

[54] MARINE PROPULSION DEVICE HYDRAULIC SYSTEM

[75] Inventor: Arthur R. Ferguson, Northbrook, Ill.

[73] Assignee: Outboard Marine Corporation, Waukegan, Ill.

[21] Appl. No.: 779,478

[22] Filed: Sep. 25, 1985

Related U.S. Application Data

[63] Continuation-in-part of Ser. No. 752,362, Jul. 3, 1985, and a continuation-in-part of Ser. No. 710,494, Mar. 11, 1985, which is a continuation-in-part of Ser. No. 614,821, May 29, 1984, and a continuation-in-part of Ser. No. 614,815, May 29, 1984, Pat. No. 4,592,732, which is a continuation-in-part of Ser. No. 605,141, Apr. 30, 1984, Pat. No. 4,545,770, which is a continuation-in-part of Ser. No. 293,324, Aug. 17, 1981, Pat. No. 4,449,945.

[51] Int. Cl.[4] ..... B63H 25/42

[52] U.S. Cl. ..... 440/61; 440/84; 74/480 B

[58] Field of Search ..... 440/53, 61, 75, 84, 440/86, 87, 900; 74/480 B; 417/199 R, 231, 426; 114/144 R

[56] References Cited

U.S. PATENT DOCUMENTS

| | | | |
|---|---|---|---|
| 1,692,473 | 11/1928 | Smith . | |
| 2,462,732 | 2/1949 | Dusevoir | 103/136 |
| 2,902,935 | 9/1959 | Dinnison et al. | 103/4 |
| 3,014,429 | 12/1961 | Doble | 103/4 |
| 3,344,745 | 10/1967 | Scognamillo | 103/4 |
| 3,551,081 | 12/1970 | Brundage | 418/171 |
| 3,590,798 | 7/1971 | Goodwin | 123/198 D |
| 3,740,954 | 6/1973 | Young | 60/489 |
| 3,799,102 | 3/1974 | Smith | 440/53 |
| 3,884,196 | 5/1975 | Grob et al. | 123/8.41 |
| 3,898,810 | 8/1975 | Ohba et al. | 60/413 |
| 3,910,044 | 10/1975 | Symmank | 60/420 |
| 3,916,767 | 11/1975 | Barton | 91/412 |
| 4,386,894 | 6/1983 | Barto | 418/215 |
| 4,416,636 | 11/1983 | Boda | 440/61 |
| 4,430,047 | 2/1984 | Ilg | 417/426 |
| 4,497,618 | 2/1985 | Anderson et al. | 417/426 |

*Primary Examiner*—Jeffrey V. Nase
*Assistant Examiner*—Stephen P. Avila
*Attorney, Agent, or Firm*—Michael, Best & Friedrich

[57] ABSTRACT

A marine propulsion device comprising a propulsion unit adapted to be pivotally mounted on the transom of a boat for pivotal movement relative to the transom about a steering axis, the propulsion unit including a rotatably mounted propeller, an engine including a throttle lever, and a shiftable transmission drivingly connecting the engine to the propeller and including a shift lever, a hydraulic shift assist system connected to the shift lever for actuation thereof, a hydraulic throttle assist system connected to the throttle lever for actuation thereof, a hydraulic fluid reservoir, a pump communicating with the reservoir, a supply conduit communicating between the pump and the shift assist system, a supply conduit communicating between the shift assist system and the throttle assist system, and a return conduit communicating between the throttle assist system and the reservoir.

35 Claims, 7 Drawing Figures

MARINE PROPULSION DEVICE HYDRAULIC SYSTEM

RELATED APPLICATIONS

This application is a continuation-in-part of U.S. patent application Ser. No. 752,362, filed July 3, 1985. This application is also a continuation-in-part of U.S. patent application Ser. No. 710,494, filed Mar. 11, 1985, which in turn is a continuation-in-part of Ser. No. 614,821, filed May 29, 1984. This application is also a continuation-in-part of U.S. patent application Ser. No. 614,815, filed May 29, 1984, now U.S. Pat. No. 4,592,732, issued June 3, 1986, which in turn is a continuation-in-part of Ser. No. 605,141, filed Apr. 30, 1984, now U.S. Pat. No. 4,545,770, issued Oct. 8, 1985, which in turn is a continuation of Ser. No. 293,324, filed Aug. 17, 1981, now U.S. Pat. No. 4,449,945, issued May 22, 1984.

BACKGROUND OF THE INVENTION

The invention relates to marine propulsion device hydraulic systems, and more particularly to such hydraulic systems including hydraulic power steering, hydraulic shift assist, and hydraulic throttle assist. Still more particularly, the invention relates to pump assemblies used in marine propulsion device hydraulic systems.

Attention is directed to the following U.S. Pat. Nos.:

| | | |
|---|---|---|
| Smith | 1,692,473 | Nov. 20, 1928 |
| Dusevoir | 2,462,732 | Feb. 22, 1949 |
| Dinnison, et al. | 2,902,935 | Sept. 8, 1959 |
| Doble | 3,014,429 | Dec. 26, 1961 |
| Scognamillo | 3,344,745 | Oct. 3, 1967 |
| Brundage | 3,551,081 | Dec. 29, 1970 |
| Goodwin | 3,590,798 | July 6, 1971 |
| Young | 3,740,954 | June 26, 1973 |
| Grob, et al. | 3,884,196 | May 20, 1975 |
| Ohba, et al. | 3,898,810 | Aug. 12, 1975 |
| Symmank | 3,910,044 | Oct. 7, 1975 |
| Barton | 3,916,767 | Nov. 4, 1975 |
| Barto | 4,386,894 | June 7, 1983 |

SUMMARY OF THE INVENTION

The invention provides a marine propulsion device comprising a propulsion unit adapted to be pivotally mounted on the transom of a boat for pivotal movement relative to the transom about a steering axis, the propulsion unit including a rotatably mounted propeller, an engine including throttle means, and a shiftable transmission drivingly connecting the engine to the propeller and including shift means, hydraulic shift assist means connected to the shift means for actuation thereof, hydraulic throttle assist means connected to the throttle means for actuation thereof, a hydraulic fluid reservoir, a pump communicating with the reservoir, supply conduit means communicating between the pump and one of the throttle assist means and the shift assist means, supply conduit means communicating between the one of the throttle assist means and the shift assist means and the other of the throttle assist means and the shift assist means, and return conduit means communicating between the other of the throttle assist means and the shift assist means and the reservoir.

In one embodiment, the one of the throttle assist means and the shift assist means includes first valve means, the other of the throttle assist means and the shift assist means includes second valve means, the first-mentioned supply conduit means communicates between the reservoir and the first valve means, the second-mentioned supply conduit means communicates between the first valve means and the second valve means, and the return conduit means communicates between the second valve means and the reservoir.

In one embodiment, the marine propulsion device further comprises check valve means for permitting flow from the return conduit means to the first-mentioned supply conduit means and for preventing flow from the first-mentioned supply conduit means to the return conduit means, and relief valve means for permitting flow from the first-mentioned supply conduit means to the return conduit means when the pressure in the first-mentioned supply conduit means reaches a predetermined value.

The invention also provides a marine propulsion device comprising a propulsion unit adapted to be pivotally mounted on the transom of a boat for pivotal movement relative to the transom about a steering axis, the propulsion unit including a rotatably mounted propeller, an engine including throttle means, and a shiftable transmission drivingly connecting the engine to the propeller and including shift means, hydraulic steering means connected to the propulsion unit for causing pivotal movement of the propulsion unit about the steering axis, hydraulic shift assist means connected to the shift means for actuation thereof, hydraulic throttle assist means connected to the throttle means for actuation thereof, a hydraulic fluid reservoir, a first pump housing defining a first pump chamber communicating with the reservoir, first supply conduit means communicating between the first pump chamber and the steering means, first return conduit means communicating between the steering means and the reservoir, a second pump housing defining a second pump chamber communicating with the reservoir, second supply conduit means communicating between the second pump chamber and one of the throttle assist means and the shift assist means, third supply conduit means communicating between the one of the throttle assist means and the shift assist means and the other of the throttle assist means and the shift assist means, and second return conduit means communicating between the other of the throttle assist means and the shift assist means and the reservoir.

In one embodiment, the marine propulsion device further comprises means communicating with the first return conduit means for cooling the fluid therein.

In one embodiment, the marine propulsion device further comprises filter means communicating with the first return conduit means.

In one embodiment, the first pump chamber has therein a first pumping element, the second pump chamber has therein a second pumping element, and the marine propulsion device further comprises a pump assembly including the reservoir, the first pump housing, the second pump housing, and a drive shaft having mounted thereon the first pumping element and the second pumping element.

The invention also provides a pump assembly comprising a housing assembly including a reservoir housing defining a reservoir and having an underside, a first pump housing mounted on the underside of the reservoir housing and defining a first pump chamber communicating with the reservoir, the first pump housing having an underside, a second pump housing mounted on the underside of the first pump housing and defining a second pump chamber communicating with the reservoir, a first outlet communicating with the first pump chamber, and a second outlet communicating with the second pump chamber, a first pumping element located in the first pump chamber, a second pumping element located in the second pump chamber, and a drive shaft rotatably supported in the housing assembly and having mounted thereon the first pumping element and the second pumping element.

In one embodiment, the drive shaft has an upper end extending upwardly from the reservoir housing, and a lower end extending into the second pump housing and having mounted thereon the second pumping element, and the first pumping element is mounted on the drive shaft intermediate the upper and lower ends.

In one embodiment, the upper end of the drive shaft has mounted thereon a drive pulley.

In one embodiment, the pump assembly further comprises a passage communicating between the reservoir and the second pump chamber and being located in the first pump housing, a first outlet passage communicating between the first pump chamber and the first outlet and being located in the second pump housing, and a second outlet passage communicating between the second pump chamber and the second outlet and being located in the second pump housing.

In one embodiment, the housing assembly further includes a first inlet and a second inlet both communicating with the reservoir.

The invention also provides a pump assembly comprising a housing assembly including a reservoir housing defining a reservoir, a first pump housing mounted on the reservoir housing and defining a first pump chamber communicating with the reservoir, a second pump housing mounted on the first pump housing and defining a second pump chamber, a passage communicating between the reservoir and the second pump chamber and being located in the first pump housing, a first outlet located in the second pump housing, a first outlet passage communicating between the first pump chamber and the first outlet and being located in in the second pump housing, a second outlet located in the second pump housing, and a second outlet passage communicating between the second pump chamber and the second outlet and being located in the second pump housing, a first pumping element located in the first pump chamber, a second pumping element located in the second pump chamber, and a drive shaft rotatably supported in the housing assembly and having mounted thereon the first pumping element and the second pumping element.

A principal feature of the invention is the provision of a marine propulsion device comprising, in part, a pump, supply conduit means communicating between the pump and shift assist means, supply conduit means communicating between the shift assist means and throttle assist means, and return conduit means communicating between the throttle assist means and a reservoir. This arrangement utilizes a single pump for both shift assist and throttle assist. This is possible because shifting and throttling are properly performed sequentially rather than simultaneously (automatically the case if a single lever remote control is used).

Another principal feature of the invention is the above-described pump assembly. This pump assembly permits use of a single pump assembly for providing hydraulic fluid to a power steering system and to shift and throttle systems of a marine propulsion device.

Other features and advantages of the invention will become apparent to those skilled in the art upon review of the following detailed description, claims, and drawings.

Figure 1:
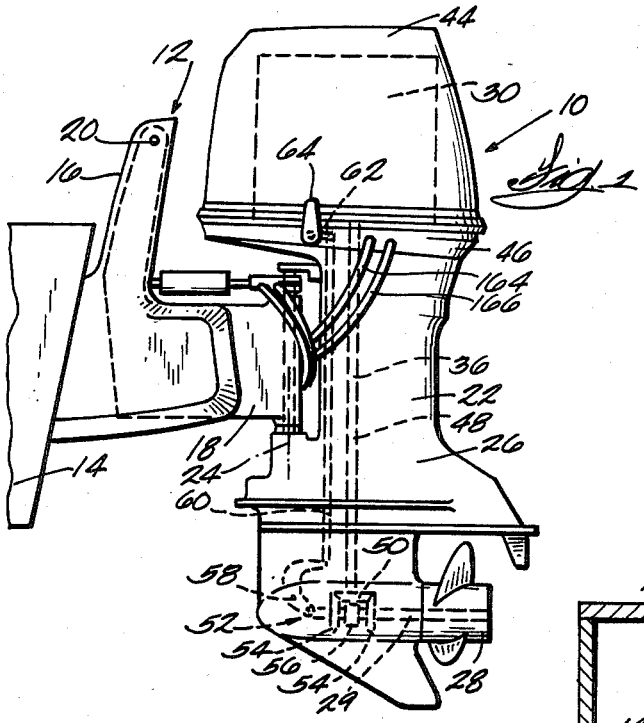
FIG. 1 is a side elevational view of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. As best shown in FIG. 1, the marine propulsion device 10 comprises a mounting assembly 12 fixedly attached to the transom 14 of a boat. In the preferred embodiment, the mounting assembly 12 includes a transom bracket 16 fixedly attached to the transom 14, and a swivel bracket 18 pivotally mounted on the transom bracket 16 for pivotal movement of the swivel bracket 18 relative to the transom 14 about a generally horizontal tilt axis 20.

The marine propulsion device 10 also comprises a propulsion unit 22 pivotally mounted on the swivel bracket 18 for pivotal movement of the propulsion unit 22 relative to the swivel bracket 18 about a generally vertical steering axis 24. The propulsion unit 22 includes a lower unit 26 including a propeller 28 mounted on a rotatably mounted propeller shaft 29, and an internal combustion engine 30 mounted on the lower unit 26. In the preferred embodiment, the engine 30 includes an engine block 32 (shown in outline in FIGS. 2 and 3), and a generally vertical crankshaft 34 (FIG. 2) rotatably mounted in the engine block 32 and having an upper end extending upwardly from the engine block 32, and a lower end drivingly connected to the propeller 28 by a drive train 36. The engine 30 also includes a flywheel 38 mounted on the upper end of the crankshaft 34, a conventional throttle lever or means 40 (shown schematically in FIG. 5), and a water jacket 42 (shown schematically in FIG. 3). The marine propulsion device 10 further comprises a housing surrounding the engine and including upper and lower covers 44 and 46, respectively.

In the preferred embodiment, the drive train 36 includes a generally vertical drive shaft 48 having an upper end driven by the crankshaft 34, and a lower end having thereon a drive gear 50. The drive train 36 also includes a shiftable or reversible transmission 52 drivingly connecting the drive gear 50 to the propeller shaft 29. While any suitable transmission can be used, in the preferred embodiment, the transmission 52 includes (see FIG. 1) a pair of axially spaced bevel gears 54 which are mounted for rotation coaxially with and independently of the propeller shaft 29 and which mesh with the drive gear 50. The transmission 52 also includes a shiftable clutch dog 56 which is carried on the propeller shaft 29 between the bevel gears 54. As is known in the art, the clutch dog 56 is movable axially relative to the propeller shaft 29 between neutral, forward drive, and reverse drive positions. The transmission 52 also includes shift means including a shift actuator 58 operably connected to the clutch dog 56, and a control or actuating rod 60 supported in the propulsion unit 22 for generally reciprocal vertical movement. The lower end of the actuating rod 60 is operably connected to the shift actuator 58 to effect axial movement of the clutch dog 56 relative to the propeller shaft 29 in response to vertical movement of the actuating rod 60. The upper end of the actuating rod 60 is pivotally connected to an arm 62 fixedly attached to a shift lever 64 rotatably mounted on the propulsion unit 22. Pivotal movement of the shift lever 64 causes pivotal movement of the arm 62, which in turn causes reciprocal vertical movement of the actuating rod 60.

Figure 5:
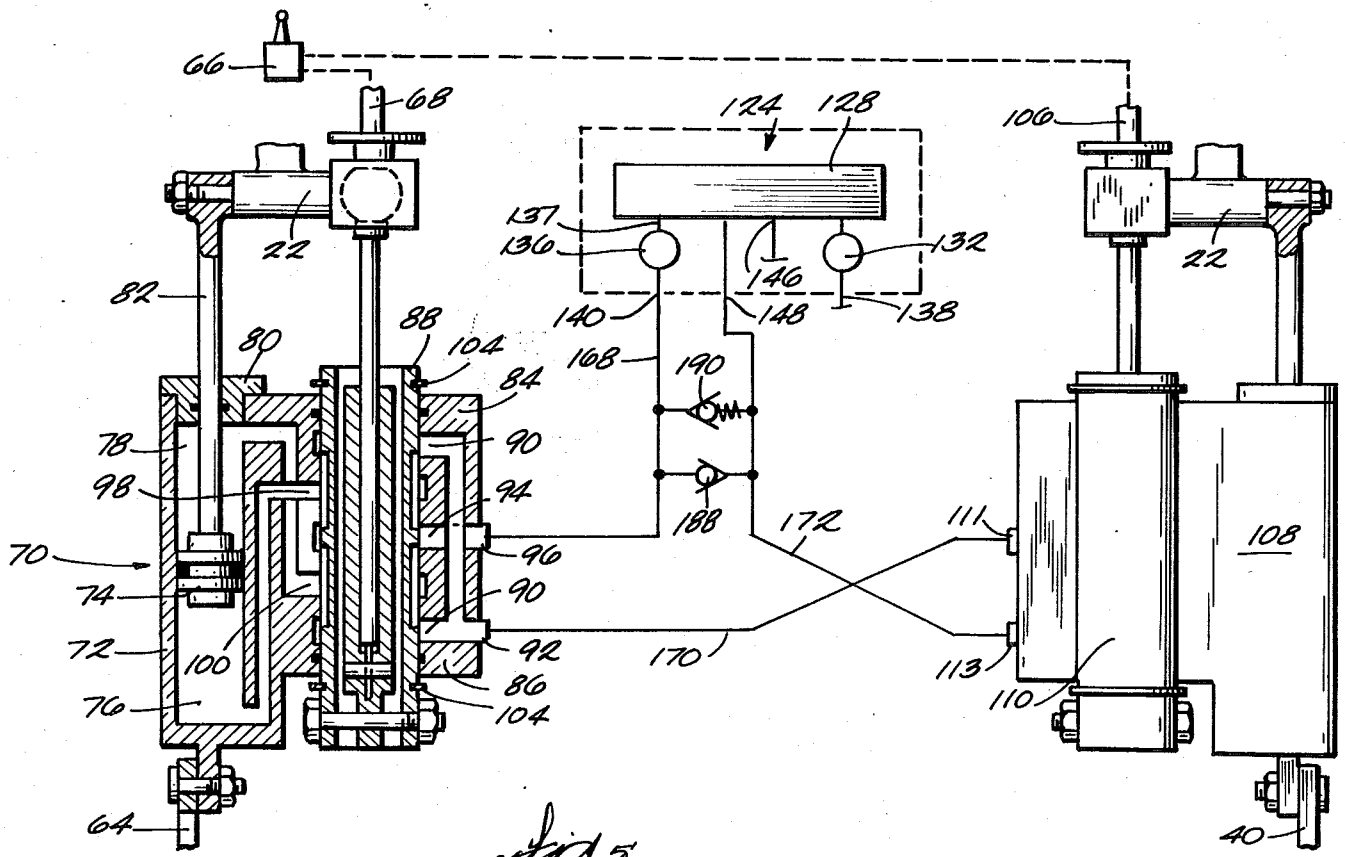
FIG. 5 is a partially schematic, partially cross-sectional view of the shift assist and throttle assist of the marine propulsion device.

The marine propulsion device 10 also comprises hydraulic shift assist means connected between a remotely located shift actuator or device such as a single lever remote control 66 (see FIG. 5) and the shift lever 64 for actuation of the shift lever 64. The remote control 66 is connected to the shift assist means by a push-pull cable assembly 68. In the illustrated construction, as best shown in FIG. 5, the shift assist means is wholly supported on the propulsion unit 22 and includes a hydraulic cylinder-piston assembly 70 which is connected between the end of the push-pull cable 68 and the shift lever 64 and which, when it extends or retracts, effects pivotal movement of the shift lever 64.

The hydraulic cylinder-piston assembly 70 includes a cylinder 72 having a fixed, longitudinal axis, and a piston 74 mounted inside the cylinder 72 for axial reciprocative movement. The Piston 74 divides the cylinder 72 into opposite sides or first and second pressure chambers 76 and 78.

One end of the cylinder 72 is closed by an end wall 80 including a central aperture. The opposite end of the cylinder 72 is pivotally connected to the shift lever 64 for effecting movement of the shift lever 64 in response to axial movement of the cylinder 72. The inner end of a piston rod 82 slidably extends through the end wall aperture and is fixedly connected to the piston 74, and the outer end of the piston rod 82 extends outwardly from the cylinder 72 and is pivotally connected to the propulsion unit 22 against axial movement of the piston rod 82.

The piston 74 is moved relative to the cylinder 72 (actually, the cylinder 72 moves and the piston 74 is fixed) by pressurized hydraulic fluid.

The shift assist means also includes control means for selectively controlling the flow of hydraulic fluid to and from the first and second pressure chambers 76 and 78 of the cylinder 72 to extend and retract the piston rod 82. In the illustrated construction, the control means includes an open-center control valve 84 including a valve housing 86 and a spool valve 88 movable relative to each other. The spool valve 88 is connected to the push-pull cable 68 and is axially movable relative to the valve housing 86 in response to movement of the push-pull cable 68. The valve housing 86 is fixedly connected to the cylinder 72 for common movement therewith.

The valve housing 86 has two return ports 90 communicating with an outlet passage 92, and an inlet port 94 communicating with an inlet passage 96. The housing 86 also has first and second control ports 98 and 100 communicating respectively with the first and second pressure chambers 76 and 78.

The spool valve 88 is mounted in the valve housing 86 for axial movement between a first position and a second position on opposite sides of a third, center, or no-change position. In the illustrated construction, the spool valve 88 is tubular and has lands. Since the control valve 84 is open-centered, the lands do not close the inlet port 94 and return ports 90 when the spool valve 88 is in the no-change position. Instead, the ports are partially open allowing constant fluid flow in through the inlet port 94 and out through both return ports 90. The spool valve 88 also has shoulder means for engaging the opposite ends of the valve housing 86 to facilitate manual shifting in the event the shift assist means fails. In the illustrated construction, the shoulder means includes snap rings 104 on the opposite ends of the spool valve 88.

The marine propulsion device 10 also comprises throttle assist means connected between a remotely located throttle actuator such as the above-mentioned single lever remote control 66 for actuating the throttle lever 40. The remote control 66 is connected to the throttle assist means by a push-pull cable assembly 106. The throttle assist means is wholly supported on the propulsion unit 22 and is substantially identical to the shift assist means. Accordingly, the throttle assist means includes (see FIG. 5) a hydraulic cylinder-piston assembly 108 which is connected between the end of the push-pull cable 106 and the throttle lever 40 and which, when it extends or retracts, effects pivotal movement of the throttle lever 40. The throttle assist means also includes an open-center control valve 110 for selectively extending and retracting the assembly 108 in response to actuation of the single lever remote control 66 and in response to the resultant axial movement of the push-pull cable 106. The control valve 110 includes an inlet passage 111, and an outlet passage 113.

Figure 6:
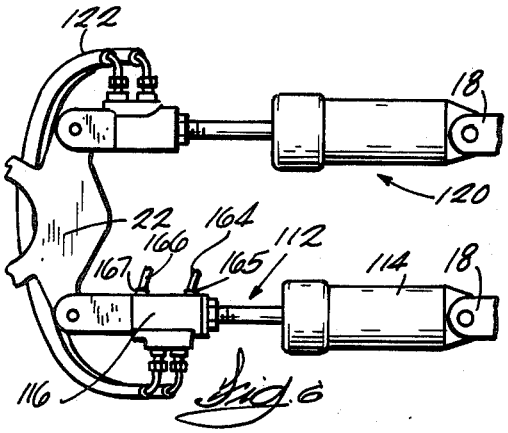
FIG. 6 is a partial top view of the power steering means.

The marine propulsion device 10 further comprises (see FIGS. 1 and 6) hydraulic power steering means connected between the propulsion unit 22 and the swivel bracket 18 for causing pivotal steering movement of the propulsion unit 22 about the steering axis 24. While various suitable power steering means can be used, in the preferred embodiment, the power steering means includes a first hydraulic assembly 112 including an actuating assembly 114 connected to the swivel bracket 18 and controlled by a remote helm (not shown), and a spool valve assembly 116 connected to a steering arm 118 fixedly attached to the propulsion unit 22. The spool valve assembly 116 is actuated by the actuating assembly 114. The power steering means also includes a second hydraulic assembly 120 connected between the swivel bracket 18 and the steering arm 118 for causing pivotal steering movement of the propulsion unit 22. The power steering means further includes hydraulic fluid conduits 122 communicating between the spool valve assembly 116 and the second hydraulic assembly 120 for actuation thereof. An example of such a power steering means is described in greater detail in Ferguson U.S. patent application Ser. No. 614,815, filed May 29, 1984, which is incorporated herein by reference.

The marine propulsion device 10 further comprises a pump assembly 124 for supplying hydraulic fluid or oil to the power steering means, the shift assist means, and the throttle assist means. In the preferred embodiment, the pump assembly 124 is removably mounted on the side of the engine block 32.

The pump assembly 124 comprises (see FIG. 4) a housing assembly including a reservoir housing 126 defining a reservoir 128, and a first Pump housing 130 mounted on the reservoir housing 126 and defining a first pump chamber 132 communicating with the reservoir 128. The housing assembly further includes a second pump housing 134 mounted on the first pump housing 130 and defining a second pump chamber 136. In the preferred embodiment, each of the reservoir housing 126 and the first pump housing 130 has an underside, and the first pump housing 130 is mounted on the underside of the reservoir housing 126, and the second pump housing 134 is mounted on the underside of the first pump housing 130.

The housing assembly further includes a passage 137 communicating between the reservoir 128 and the second pump chamber 136 and being located in the first pump housing 130, and first and second outlets 138 and 140 located in the second pump housing 134. The housing assembly further includes a first outlet passage 142 communicating between the first pump chamber 132 and the first outlet 138 and being located in the second pump housing 134, and a second outlet passage 144 communicating between the second pump chamber 136 and the second outlet 140 and being located in the second pump housing 134. The housing assembly further includes first and second inlets 146 and 148 both communicating with the reservoir 128.

The pump assembly 124 further comprises a first pumping element 150 located in the first pump chamber 132, a second pumping element 152 located in the second pump chamber 136, and a drive shaft 154 rotatably supported in the housing assembly by upper and lower bearings 156 and 157, respectively, and having mounted thereon the first and second pumping elements 150 and 152. In the preferred embodiment, the first and second pumping elements 150 and 152 are conventional gerotors, although they can be any suitable pumping element, e.g., a sliding vane impeller.

In the preferred embodiment, the passage 137 communicating between the reservoir 128 and the second pump chamber 136 also communicates with the first pump chamber 132. Additionally, the first outlet passage 142 is located in the first pump housing 130 as well as in the second pump housing 134.

Figure 4:
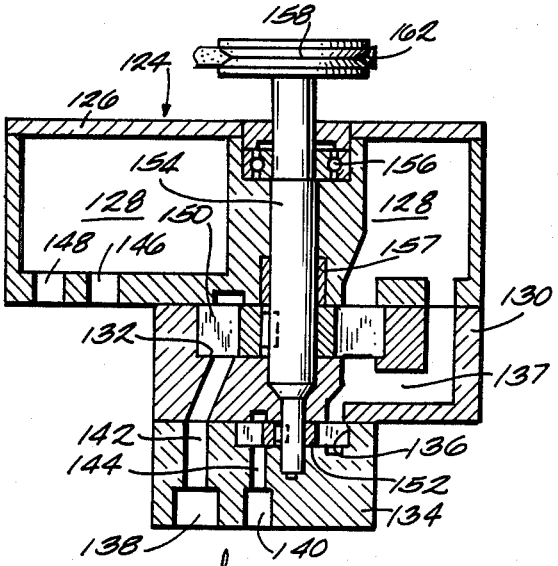
FIG. 4 is an enlarged, cross-sectional view of the pump assembly shown in FIG. 3.
Figure 3:
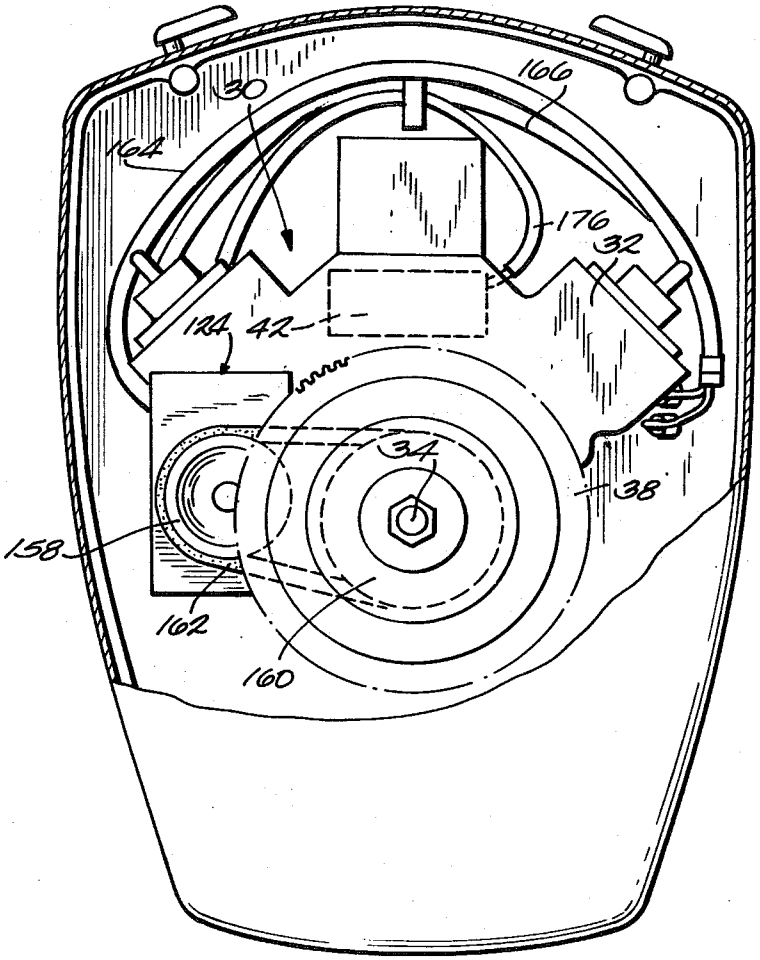
FIG. 3 is an enlarged top view, partially cut away, of the marine propulsion device.

In the preferred embodiment, as best shown in FIGS. 3 and 4, the upper end of the drive shaft 154 has a drive pulley 158 mounted thereon, the engine 30 further includes a power takeoff pulley 60, and the marine propulsion device 10 further comprises belt means 162 drivingly connecting the power takeoff pulley 160 to the drive pulley 158. While various suitable power takeoff pulleys can be employed, in the illustrated construction, the power takeoff pulley 160 is an annular pulley mounted on the underside of the flywheel 38. Such an arrangement is disclosed in greater detail in Ferguson U.S. patent application Ser. No. 752,362, filed July 3, 1985, and titled "Marine Propulsion Device Power Steering System," which is incorporated herein by reference.

If desired, the marine propulsion device 10 can further comprise an idler pulley (not shown) rotatably mounted for rotation about a generally vertical axis, with the belt means 162 extending around the power takeoff pulley 160, the drive pulley 158, and the idler pulley.

Figure 7:
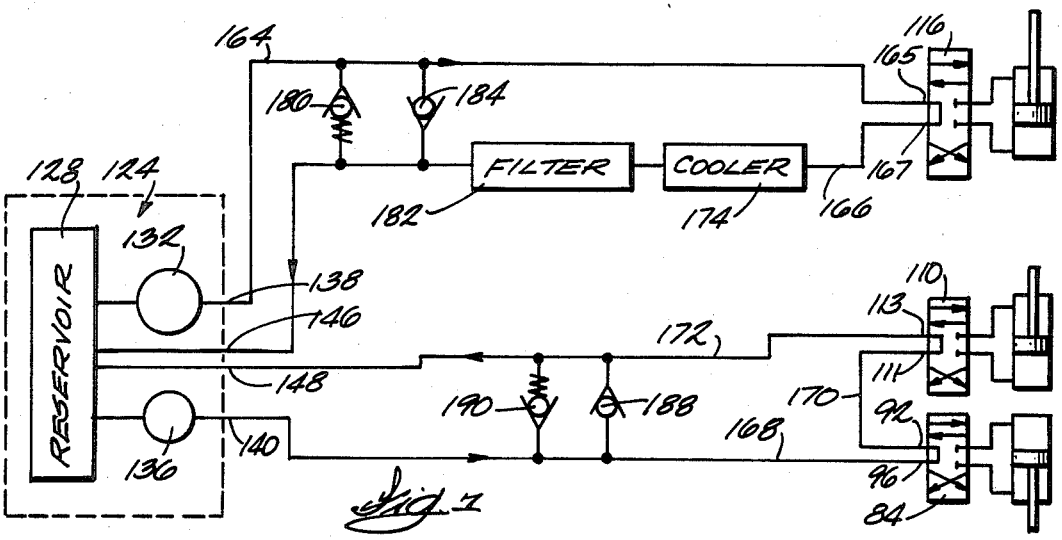
FIG. 7 is a schematic diagram of the hydraulic system of the marine propulsion device.

The marine propulsion device 10 further comprises (see FIGS. 2, 3 and 7) a hydraulic steering circuit including first supply conduit means 164 communicating between the first outlet 138 and an inlet 165 in the spool valve assembly 116 for supplying hydraulic fluid to the steering means, and first return conduit means 166 communicating between an outlet 167 in the spool valve assembly 116 and the first reservoir inlet 146. The marine propulsion device 10 further comprises (see FIGS. 2, 5 and 7) a hydraulic shift/throttle circuit including second supply conduit means 168 communicating between the second outlet 140 and the shift control valve inlet passage 96, third supply conduit means 170 communicating between the shift control valve outlet passage 92 and the throttle control valve inlet passage 111, and second return conduit means 172 communicating between the throttle control valve outlet passage 113 and the second inlet 148.

It should be understood that in alternative embodiments the positions of the shift assist means and throttle assist means can be reversed, with the second supply conduit means 168 communicating between the second outlet 140 and the throttle assist means, with the third supply conduit means 170 communicating between the throttle assist means and the shift assist means, and with the second return conduit means 172 communicating between the shift assist means and the second inlet 148. This reversal is possible because the shift and throttle control valves 84 and 110 are open-centered, and because the shift assist means and throttle assist means operate sequentially.

As best shown in FIGS. 1 and 3, the first supply conduit means 164 extends around the rear of the engine 30 from the first outlet 138 and through the lower motor cover 46 on the port side of the engine 30, and then between the propulsion unit 22 and the swivel bracket 18 to the starboard side of the engine 30 where it communicates with the spool valve assembly 116. The first return conduit means 166 extends from the spool valve assembly 116 to the first inlet 146 along a path parallel to the path of the first supply conduit means 164.

In the preferred embodiment, the flow and pressure requirements of the steering means are substantially greater than the flow and pressure requirements of the shift and throttle means. Accordingly, the first pump chamber 132 is substantially larger than the second pump chamber 136.

The marine propulsion device 10 further comprises means communicating with the first return conduit means 166 for cooling the fluid therein. Because all of the hydraulic fluid flows into a common reservoir, sufficient cooling of the hydraulic fluid is obtained by cooling only the fluid flowing through the high-flow steering circuit. While various suitable cooling means can be used, in the preferred embodiment, the cooling means includes (see FIG. 2) a hydraulic fluid or oil cooler 174 communicating with the first return conduit means 166.

Preferably, the fluid cooler 174 includes a fluid chamber or passage (not shown) communicating with the first return conduit means 166, and a plurality of water passages (not shown) extending through the fluid chamber and communicating with a source of cooling water. Preferably, the fluid cooler 174 is mounted on the side of the engine block 32, as best shown in FIG. 2.

Figure 2:
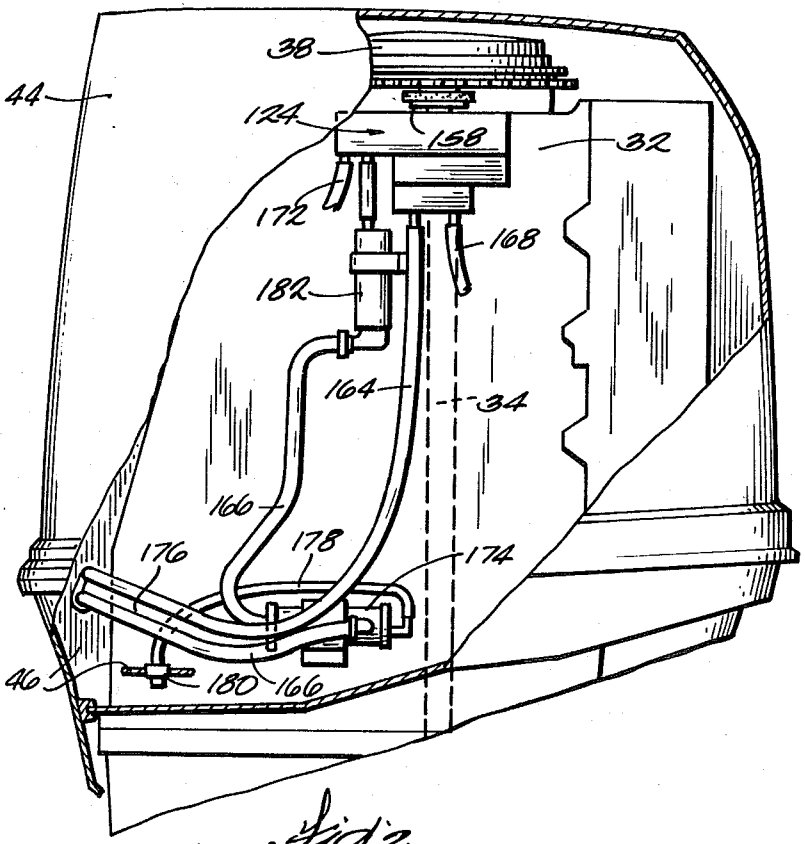
FIG. 2 is an enlarged side elevational view, partially cut away, of the marine propulsion device.

In the preferred embodiment, as best shown in FIGS. 2 and 3, the source of cooling water includes a conduit 176 communicating between the water jacket 42 and the fluid cooler water passages for providing cooling water to the fluid cooler 174. Water is discharged from the fluid cooler 174 via a conduit 178 having an inlet end communicating with the fluid cooler 174, and an outlet end extending through a grommet 180 seated in an opening in the lower motor cover 46. Thus, the conduit 178 provides what is known in the art as a telltale discharge.

The marine propulsion device 10 further comprises filter means communicating with the first return conduit means 166. While various suitable filter means can be employed, in the illustrated construction, the filter means includes (see FIG. 2) a fluid or oil filter 182 communicating with the first return conduit means 166 between the cooler 174 and the first inlet 146.

In the preferred embodiment, the marine propulsion device 10 further comprises (see FIG. 7) first check valve means 184 for permitting flow from the first return conduit means 166 to the first supply conduit means 164 and for preventing flow from the first supply conduit means 164 to the first return conduit means 166, and first relief valve means 186 for permitting flow from the first supply conduit means 164 to the first return conduit means 166 when the pressure in the first supply conduit means 164 reaches a predetermined value. The marine propulsion device 10 preferably further comprises (see FIGS. 5 and 7) second check valve means 188 for permitting flow from the second return conduit means 172 to the second supply conduit means 168 and for preventing flow from the second supply conduit means 168 to the second return conduit means 172, and second relief valve means 190 for permitting flow from the second supply conduit means 168 to the second return conduit means 172 when the pressure in the second supply conduit means 168 reaches a predetermined value.

The first and second check valve means 184 and 188 allow bypass of the pump assembly 124 so that, if the pump assembly 124 fails and manual steering, shifting, or throttling is performed, hydraulic fluid does not have to pass through the failed pump assembly 124. In the preferred embodiment, the first predetermined value is greater than the second predetermined value so that the power steering means is operated at a greater pressure than the shift and throttle means.

Various features and advantages of the invention are set forth in the following claims.

I claim:

1. A marine propulsion device comprising a propulsion unit adapted to be pivotally mounted on the transom of a boat for pivotal movement relative to the transom about a steering axis, said propulsion unit including a rotatably mounted propeller, an engine including throttle means, and a shiftable transmission drivingly connecting said engine to said propeller and including shift means, hydraulic shift assist means connected to said shift means for actuation thereof, hydraulic throttle assist means connected to said throttle means for actuation thereof, a hydraulic fluid reservoir, a pump communicating with said reservoir, supply conduit means communicating between said pump and one of said throttle assist means and said shift assist means, supply conduit means communicating between said one of said throttle assist means and said shift assist means and the other of said throttle assist means and said shift assist means, and return conduit means communicating between said other of said throttle assist means and said shift assist means and said reservoir.

2. A marine propulsion device as set forth in claim 1 wherein said one of said throttle assist means and said shift assist means includes first valve means, wherein said other of said throttle assist means and said shift assist means includes second valve means, wherein said first-mentioned supply conduit means communicates between said reservoir and said first valve means, wherein said second-mentioned supply conduit means communicates between said first valve means and said second valve means, and wherein said return conduit means communicates between said second valve means and said reservoir.

3. A marine propulsion device as set forth in claim 1 and further comprising check valve means for permitting flow from said return conduit means to said first-mentioned supply conduit means and for preventing flow from said first-mentioned supply conduit means to said return conduit means, and relief valve means for permitting flow from said first-mentioned supply conduit means to said return conduit means when the pressure in said first-mentioned supply conduit means reaches a predetermined value.

4. A marine propulsion device comprising a propulsion unit adapted to be pivotally mounted on the transom of a boat for pivotal movement relative to the transom about a steering axis, said propulsion unit including a rotatably mounted propeller, an engine, and a shiftable transmission drivingly connecting said engine to said propeller and including shift means, hydraulic steering means connected to said propulsion unit for causing pivotal movement of said propulsion unit about said steering axis, hydraulic shift assist means connected to said shift means for actuation thereof, a hydraulic fluid reservoir, a first pump housing defining a first pump chamber communicating with said reservoir, first supply conduit means communicating between said first pump chamber and said steering means, first return conduit means communicating between said steering means and said reservoir, a second pump housing defining a second pump chamber communicating with said reservoir, second supply conduit means communicating between said second pump chamber and said shift assist means, and second return conduit means communicating between said shift assist means and said reservoir.

5. A marine propulsion device comprising a propulsion unit adapted to be pivotally mounted on the transom of a boat for pivotal movement relative to the transom about a steering axis, said propulsion unit including a rotatably mounted propeller, and an engine drivingly connected to said propeller and including throttle means, hydraulic steering means connected to said propulsion unit for causing pivotal movement of said propulsion unit about said steering axis, hydraulic throttle assist means connected to said throttle means for actuation thereof, a hydraulic fluid reservoir, a first pump housing defining a first pump chamber communicating with said reservoir, first supply conduit means communicating between said first pump chamber and said steering means, first return conduit means communicating between said steering means and said reservoir, a second pump housing defining a second pump chamber communicating with said reservoir, second supply conduit means communicating between said second pump chamber and said throttle assist means, and second return conduit means communicating between said throttle assist means and said reservoir.

6. A marine propulsion device comprising a propulsion unit adapted to be pivotally mounted on the transom of a boat for pivotal movement relative to the transom about a steering axis, said propulsion unit including a rotatably mounted propeller, an engine including throttle means, and a shiftable transmission drivingly connecting said engine to said propeller and including shift means, hydraulic steering means connected to said propulsion unit for causing pivotal movement of said propulsion unit about said steering axis, hydraulic shift assist means connected to said shift means for actuation thereof, hydraulic throttle assist means connected to said throttle means for actuation thereof, a hydraulic fluid reservoir, a first pump housing defining a first pump chamber communicating with said reservoir, first supply conduit means communicating between said first pump chamber and said steering means, first return conduit means communicating between said steering means and said reservoir, a second pump housing defining a second pump chamber communicating with said reservoir, second supply conduit means communicating between said second pump chamber and one of said throttle assist means and said shift assist means, third supply conduit means communicating between said one of said throttle assist means and said shift assist means and the other of said throttle assist means and said shift assist means, and second return conduit means communicating between said other of said throttle assist means and said shift assist means and said reservoir.

7. A marine propulsion device as set forth in claim 6 wherein said steering means includes first valve means, wherein said one of said throttle assist means and said shift assist means includes second valve means, wherein said other of said throttle assist means and said shift assist means includes third valve means, wherein said first supply conduit means communicates between said first pump and said first valve means, wherein said first return conduit means communicates between said first valve means and said reservoir, wherein said second supply conduit means communicates between said second pump and said second valve means, wherein said third supply conduit means communicates between said second valve means and said third valve means, and wherein said second return conduit means communicates between said third valve means and said reservoir.

8. A marine propuslion device as set forth in claim 6 and further comprising first check valve means for permitting flow from said first return conduit means to said first supply conduit means and for preventing flow from said first supply conduit means to said first return conduit means, first relief valve means for permitting flow from said first supply conduit means to said first return conduit means when the pressure in said first supply conduit means reaches a predetermined value, second check valve means for permitting flow from said second return conduit means to said second supply conduit means and for preventing flow from said second supply conduit means to said second return conduit means, and second relief valve means for permitting flow from said second supply conduit means to said second return conduit means when the pressure in said second supply conduit means reaches a predetermined value.

9. A marine propulsion device as set forth in claim 6 and further comprising means communicating with said first return conduit means for cooling the fluid therein.

10. A marine propulsion device as set forth in claim 6 and further comprising filter means communicating with said first return conduit means.

11. A marine propulsion device as set forth in claim 6 wherein said first pump chamber has therein a first pumping element, wherein said second pump chamber has therein a second pumping element, and wherein said marine propulsion device further comprises a pump assembly including said reservoir, said first pump housing, said second pump housing, and a drive shaft having mounted thereon said first pumping element and said second pumping element.

12. A marine propulsion device as set forth in claim 11 wherein said pump assembly further includes a housing assembly including said first pump housing, said second pump housing, and a reservoir housing defining said reservoir, a first outlet communicating with said first pump chamber, and a second outlet communicating with said second pump chamber, wherein said first pump housing is mounted on said reservoir housing, wherein said second pump housing is mounted on said first pump housing, wherein said first pumping element is located in said first pump chamber, wherein said second pumping element is located in said second pump chamber, and wherein said drive shaft is rotatably supported in said housing assembly.

13. A marine propulsion device as set forth in claim 12 wherein said drive shaft has an upper end extending upwardly from said reservoir housing, and a lower end extending into said second pump housing and having said second pumping element mounted thereon, and wherein said first pumping element is mounted on said drive shaft intermediate said upper and lower ends.

14. A marine propulsion device as set forth in claim 13 wherein said upper end of said drive shaft has mounted thereon a drive pulley.

15. A marine propulsion device as set forth in claim 14 wherein said engine includes a power takeoff pulley, and wherein said device further comprises belt means drivingly connecting said power takeoff pulley to said drive pulley.

16. A marine propulsion device as set forth in claim 12 wherein said pump assembly further comprises a passage communicating between said reservoir and said second pump chamber and being located in said first pump housing, a first outlet passage communicating between said first pump chamber and said first outlet and being located in said second pump housing, and a second outlet passage communicating between said second pump chamber and said second outlet and being located in said second pump housing.

17. A marine propulsion device as set forth in claim 12 wherein said housing assembly further includes a first inlet and a second inlet both communicating with said reservoir.

18. A pump assembly comprising a housing assembly including a reservoir housing defining a reservoir and having an underside, a first pump housing mounted on said underside of said reservoir housing and defining a first pump chamber communicating with said reservoir, said first pump housing having an underside, a second pump housing mounted on said underside of said first pump housing and defining a second pump chamber communicating with said reservoir, a first outlet communicating with said first pump chamber, and a second outlet communicating with said second pump chamber, a first pumping element located in said first pump chamber, a second pumping element located in said second pump chamber, and a drive shaft rotatably supported in said housing assembly and having mounted thereon said first pumping element and said second pumping element.

19. A pump assembly as set forth in claim 18 wherein said drive shaft has an upper end extending upwardly from said reservoir housing, and a lower end extending into said second pump housing and having mounted thereon said second pumping element, and wherein said first pumping element is mounted on said drive shaft intermediate said upper and lower ends.

20. A pump assembly as set forth in claim 19 wherein said upper end of said drive shaft has mounted thereon a drive pulley.

21. A pump assembly as set forth in claim 18 and further comprising a passage communicating between said reservoir and said second pump chamber and being located in said first pump housing, a first outlet passage communicating between said first pump chamber and said first outlet and being located in said second pump housing, and a second outlet passage communicating between said second pump chamber and said second outlet and being located in said second pump housing.

22. A pump assembly as set forth in claim 18 wherein said housing assembly further includes a first inlet and a second inlet both communicating with said reservoir.

23. A pump assembly comprising a housing assembly including a reservoir housing defining a reservoir, a first pump housing mounted on said reservoir housing and defining a first pump chamber communicating with said reservoir, a second pump housing mounted on said first pump housing and defining a second pump chamber, a passage communicating between said reservoir and said second pump chamber and being located in said first pump housing, a first outlet located in said second pump housing, a first outlet passage communicating between said first pump chamber and said first outlet and being located in said second pump housing, a second outlet located in said second pump housing, and a second outlet passage communicating between said second pump chamber and said second outlet and being located in said second pump housing, a first pumping element located in said first pump chamber, a second pumping element located in said second pump chamber, and a drive shaft rotatably supported in said housing assembly and having mounted thereon said first pumping element and said second pumping element.

24. A pump assembly as set forth in claim 23 wherein said reservoir housing has an underside, wherein said first pump housing is mounted on said underside of said reservoir housing and has an underside, and wherein said second pump housing is mounted on said underside of said first pump housing.

25. A pump assembly as set forth in claim 24 wherein said drive shaft has an upper end extending upwardly from said reservoir housing, and a lower end extending into said second pump housing and having mounted thereon said second pumping element, and wherein said first pumping element is mounted on said drive shaft intermediate said upper and lower ends.

26. A pump assembly as set forth in claim 25 wherein said upper end of said drive shaft has mounted thereon a drive pulley.

27. A pump assembly as set forth in claim 23 wherein said housing assembly includes a first inlet and a second inlet both communicating with said reservoir.

28. A marine propulsion device comprising a propulsion unit adapted to be pivotally mounted on the transom of a boat for pivotal movement relative to the transom about a steering axis, said propulsion unit including a rotably mounted propeller, an engine including throttle means, and a shiftable transmission drivingly connecting said engine to said propeller and including shift means, hydraulic steering means connected to said propulsion unit for causing pivotal movement of said propulsion unit about said steering axis, hydraulic shift assist means connected to said shift means for actuation thereof, hydraulic throttle assist means connected to said throttle means for actuation thereof, a pump assembly comprising a housing assembly including a reservoir housing defining a reservoir and having an underside, a first pump housing mounted on said underside of said reservoir housing and defining a first pump chamber communicating with said reservoir, said first pump housing having an underside, a second pump housing mounted on said underside of said first pump housing and defining a second pump chamber, a passage communicating between said reservoir and said second pump chamber and being located in said first pump housing, a first outlet located in said second pump housing, a second outlet located in said second pump housing, a first outlet passage communicating between said first pump chamber and said first outlet and being located in said second pump housing, and a second outlet passage communicating between said second pump chamber and said second outlet and being located in said second pump housing, a first pumping element located in said first pump chamber, a second pumping element located in said second pump chamber, and a drive shaft rotatably supported in said housing assembly and having mounted thereon said first pumping element and said second pumping element, first supply conduit means communicating between said first outlet and said steering means, first return conduit means communicating between said steering means and said reservoir, second supply conduit means communicating between said second outlet and one of said throttle assist means and said shift assist means, third supply conduit means communicating between said one of said throttle assist means and said shift assist means and the other of said throttle assist means and said shift assist means, and second return conduit means communicating between said other of said throttle assist means and said shift assist means and said reservoir.

29. A marine propulsion device as set forth in claim 28 wherein said steering means includes first valve means, wherein said one of said throttle assist means and said shift assist means includes second valve means, wherein said other of said throttle assist means and said shift assist means includes third valve means, wherein said first supply conduit means communicates between said first outlet and said first valve means, wherein said first return conduit means communicates between said first valve means and said reservoir, wherein said second supply conduit means communicates between said second outlet and said second valve means, wherein said third supply conduit means communicates between said second valve means and said third valve means, and wherein said second return conduit means communicates between said third valve means and said reservoir.

30. A marine propulsion device as set forth in claim 28 and further comprising first check valve means for permitting flow from said first return conduit means to said first supply conduit means and for preventing flow from said first supply conduit means to said first return conduit means, first relief valve means for permitting flow from said first supply conduit means to said first return conduit means when the pressure in said first supply conduit means reaches a predetermined value, second check valve means for permitting flow from said second return conduit means to said second supply conduit means and for preventing flow from said second supply conduit means to said second return conduit means, and second relief valve means for permitting flow from said second supply conduit means to said second return conduit means when the pressure in said second supply conduit means reaches a predetermined value.

31. A marine propulsion device as set forth in claim 28 and further comprising means communicating with said first return conduit means for cooling the fluid therein.

32. A marine propulsion device as set forth in claim 28 and further comprising filter means communicating with said first return conduit means.

33. A marine propulsion device as set forth in claim 28 wherein said drive shaft has an upper end extending upwardly from said reservoir housing, and a lower end extending into said second pump housing and having mounted thereon said second pumping element, and wherein said first pumping element is mounted on said drive shaft intermediate said upper and lower ends.

34. A marine propulsion device as set forth in claim 33 wherein said upper end of said drive shaft has mounted thereon a drive pulley.

35. A marine propulsion device as set forth in claim 34 wherein said engine includes a power takeoff pulley, and wherein said device further comprises belt means drivingly connecting said power takoff pulley to said drive pulley.

* * * * *